US009528692B2

(12) United States Patent
Kohn

(10) Patent No.: US 9,528,692 B2
(45) Date of Patent: Dec. 27, 2016

(54) PERSONAL LIGHTING SYSTEM

(71) Applicant: Gabriel S. Kohn, Boca Raton, FL (US)

(72) Inventor: Gabriel S. Kohn, Boca Raton, FL (US)

( * ) Notice: Subject to any disclaimer, the term of this patent is extended or adjusted under 35 U.S.C. 154(b) by 0 days.

(21) Appl. No.: 14/719,605

(22) Filed: May 22, 2015

(65) Prior Publication Data

US 2016/0341410 A1 Nov. 24, 2016

(51) Int. Cl.
*H05B 37/02* (2006.01)
*F21V 23/04* (2006.01)

(52) U.S. Cl.
CPC ..... *F21V 23/0464* (2013.01); *F21V 23/0407* (2013.01); *F21V 23/0471* (2013.01)

(58) Field of Classification Search
CPC ..... F21L 2/00; F21L 4/00; F21L 4/02; F21L 4/027; F21V 23/04; F21V 23/0407; F21V 23/0464; F21V 23/0471
See application file for complete search history.

(56) References Cited

U.S. PATENT DOCUMENTS 7,553,051 B2 * 6/2009 Brass ..... F21L 4/00 362/311.01
7,703,952 B2 * 4/2010 Yoon ..... F21L 4/02 362/103
7,740,371 B1 * 6/2010 Lebens ..... F21L 4/027 315/127
2005/0151040 A1 * 7/2005 Hsu ..... B62J 11/00 248/214
2007/0014101 A1 * 1/2007 Huang ..... B25B 23/18 362/119
2008/0251109 A1 * 10/2008 Lee ..... A45B 3/00 135/66
2009/0261737 A1 * 10/2009 Wright ..... F21L 4/027 315/154
2011/0176309 A1 * 7/2011 Lin ..... F21L 4/04 362/249.02
2012/0080064 A1 * 4/2012 Gorey ..... A45B 3/04 135/66
2015/0091449 A1 * 4/2015 Lemon ..... A45C 15/06 315/158

* cited by examiner

*Primary Examiner* — Jason M Crawford
(74) *Attorney, Agent, or Firm* — Lawrence J. Shurupoff

(57) ABSTRACT

A compact portable path illuminating light can be coupled to mobility assisting devices such as walking sticks, canes and wheelchairs. A night beacon can automatically illuminate at timed intervals to assist a user in locating the light in the dark. This night beacon can be selectively enabled and disabled by a user. The status of various operating modes of the light are visually confirmed through illumination of several different colored lights.

15 Claims, 9 Drawing Sheets

PERSONAL LIGHTING SYSTEM

BACKGROUND

Personal lighting systems for illuminating a pathway in low or no ambient light have been developed to assist in finding one's way in the dark. Some of these lighting systems are intended to assist those requiring mechanical assistance in walking or moving about. These systems serve as flashlights which can be attached to, for example, canes and walkers for providing an illuminated pathway in low ambient light.

Some of these lights can be operated automatically under a combination of low ambient light and motion. For example, U.S. Pat. No. 7,057,153 discloses a fully automatic lighting system which illuminates a pathway under a combination of low light and motion.

Because these lighting systems are often used by senior citizens using canes, walkers, wheel chairs, crutches and other mobility assisting devices, it is helpful to provide a user with clear and easy to understand feedback about the operation of their lighting system attached to such devices. Moreover, it is helpful to assist a user in locating a mobility assisting device in the dark, such as upon awakening from sleep during the night.

SUMMARY

A more "user friendly" lighting system has been developed which quickly, clearly, and in an easy to understand manner, provides a user with a lighting system that visually confirms the operating states or operating modes of the lighting system. By using a set of different colored indicating lights, the lighting system described below can inform and visually confirm to a user the operating states of the user's lighting system. For example, one or more lights can confirm that the lighting system is turned "on" and is in a fully operational mode. One or more lights can also confirm that the lighting system is turned "off" or in a low power "sleep" or standby operational mode.

Additional lighting system information can be provided in the form of a low battery indicator light which visually signals the need to replace one or more batteries which power the system. Another useful visual indicator is provided in the form of a system "test" which can be selected by an operator at any time and in any mode of the lighting system's operation. By selecting a test function, such as by depressing a switch, one or more lights can illuminate and/or pulse in a particular sequence and color to confirm that all subsystems in the lighting system are fully operational.

A particularly useful feature of the lighting system disclosed herein is a night light or night beacon which can be selectively enabled and disabled by a user. When enabled, the night beacon can take the form of a low power, low lumen blinking light that blinks at modestly spaced apart time intervals so as to conserve battery power. In the event a user does not want nor need the night beacon, a user can easily disable this function with a simple press of a button. For example, if a user finds a blinking night light objectionable, such as when trying to sleep, the use can selectively disable this night beacon function.

As more fully described below, the lighting system can be quickly and easily attached to, carried on or otherwise mounted to virtually any object, including animate and inanimate objects. These objects include not only mobility assisting devices, but also outdoor or sporting devices including use on helmets, headbands, (for use as headlamps), footwear, animal halters and collars, sporting, boating and cycling products as well as clothing and belts. In some applications, the lighting system can be used to locate pets or other animals in the dark with use of collars, halters and similar attachments, Although many applications for the lighting system can be envisioned, a particularly useful application is for use with walking aids, and advantageously with hand held walking sticks and canes. Because one embodiment of the lighting system is, due to its micro sized components, small and lightweight, it is well adapted for use on canes and walking sticks without encumbering the cane and user with a bulky or heavy housing or heavy electronic components.

In one embodiment, the lighting system includes three general operational modes, namely, on, off and test modes. These modes are selected by pressing one of two momentary contact or button switches for short or long periods of contact. For example, by briefly pressing and releasing an "off" switch, the microprocessor which controls all lighting functions enters a sleep or standby mode where all electronics and lights are turned off except for minimal power to the microprocessor. This mode is designed to conserve battery power by placing the microprocessor in a low power "sleep" or standby mode wherein none of the lights in the system is illuminated and wherein power to the microprocessor is negligible or minimal. This mode can be selected when the lighting system will not be used on a regular basis.

Upon pressing the off switch, a user will be positively visually informed that the lighting system has entered the off or sleep mode by, for example, a pulsed or blinking red light, such as a red light emitting diode (LED). The red LED can blink one, two, three or more times to signal the user that the lighting system has been turned off upon activation of the off switch. Three blinks or pulses of the red light have been found most adequate for this purpose. The off or sleep mode can be used when the object to which it is attached is not expected to be used on a regular basis or when the object is going to be transported in a vehicle, airplane, car trunk, or stored in a closet or other space where light is not required. The lighting system can be easily removed from the sleep mode and placed in an active mode by a simple press of an on switch.

Upon pressing the on switch, a user will be positively visually informed that the lighting system has entered the "on" operational mode by, for example, a pulsed or blinking green LED. The green LED can blink one, two, three or more times to signal to a user that the lighting system has been turned on upon activation of the on switch. Three green blinks or light pulses have been found most adequate for this purpose.

When the on switch or button is briefly pressed and released, a microprocessor leaves a sleep or standby mode and becomes fully active along with the system electronics and sensors. There can be three or more separate or "sub" operating modes when the system is placed in the on mode.

One such "on" operating mode is a night beacon mode. Under this mode, and under a combination of low or no ambient or surrounding light and little or no motion being sensed, a colored light, such as a blue LED, will blink briefly at spaced intervals such as every several seconds. A period of about five seconds between blinks of pulsed light has been found adequate to help a user locate the object to which the lighting system has been attached in low or in no light conditions.

This pulsed LED can be operated at low power levels to conserve battery power and to minimize light levels such as when a user is sleeping. As described below, if a user finds this nighttime blinking objectionable, this night beacon mode can be selectively disabled or turned off. In one embodiment, by pressing an off button for a relatively long duration or period of time, such as several seconds, the night beacon mode can be sequentially and repetitively turned on and off. For example, by pressing an off button for say, five seconds, the night beacon mode can be deactivated. By pressing the off button again for and extended duration or period of time, such as five seconds, the night beacon mode can be reactivated.

Another sub operating mode under the on mode is an active mode where both ambient light levels and motion of the lighting device are periodically sampled or polled by a microprocessor. If a low or no light level is sensed and a minimal level of motion is sensed, one or more brightly illuminated pathway lights, such as white light LEDs, are powered on by the microprocessor to illuminate a travel path.

The microprocessor can sample the ambient light level and motion level inputs provided by a light sensor and by a motion sensor and if they meet predetermined levels, the microprocessor will illuminate the white LEDs for a predetermined period. In one application, this period can be about 15 seconds, but any other reasonable period can be programmed or selected, such as 10 seconds up to a minute or more.

If the microprocessor detects a predetermined low light level and a minimal level of motion during any period of illumination of the main pathway white LEDs, the microprocessor will maintain the main pathway illumination for one additional period, e.g. another 15 seconds. However, if during any period of main pathway illumination the ambient light level increases above a predetermined level and/or the motion detected falls below a predetermined motion level, after a short delay period, the microprocessor will turn off the main pathway lights and wait for a lower light level and/or higher degree of motion before again illuminating the pathway lights.

That is, if either the ambient light level increases above the preset minimum level, or the motion level falls below the preset minimum level, or both occur during any period of pathway illumination, from that moment the pathway lights will remain illuminated for an additional predetermined lined courtesy lighting period, such as fifteen seconds and then turn off. This delay provides a temporary period of pathway illumination serving as a courtesy light for the user instead of abruptly terminating the pathway light in the middle of a period of illumination.

If during pathway illumination the ambient light level sensed increases above the minimum level and the sensed degree of motion is above the minimum level during the short period of courtesy lighting, the microprocessor will reactivate the pathway lighting mode to its fully operational status. The courtesy lighting period of extended pathway illumination acts as a buffer to prevent the loss of pathway illumination due to a short exposure to, for example, a beam of light such as from automobile headlights.

As described above, when sufficient ambient light is detected, the lighting system will prevent the pathway lights from turning on. This feature significantly conserves the battery power.

The lighting system can include a test mode which can be entered into at any time and under any operating mode. This mode can provide visual confirmation to a user that the lighting system is fully operational. In one example, the on switch can be depressed and held down for an extended period such as three, four, five seconds or more. Five seconds has been found to function well.

Once the on button or switch has been depressed for, say, five seconds, the main pathway light will illuminate for a brief period of several seconds, such as five seconds. During this period of pathway illumination, one or more indicator lights can blink or pulse as well. Two different colored LEDs can sequentially blink or a single dual colored LED, such as a green and red LED, can alternately blink red and green during this short (five second) interval.

Another useful feature of the lighting system is a low battery indicator which activates at a predetermined level of remaining battery power, such as when thirty minutes of battery capacity remains to power the main pathway light at a full or constant power level. In one embodiment, when the battery reaches a first low reserve level, a dedicated low battery indicator light, such as a red LED, will begin to blink briefly such as once every two seconds.

Further depletion of the battery to a predetermined second lower reserve level causes the low battery indicator light to blink two or more times in quick succession, for example, every two seconds. When the battery level drops to a third lower level, power drain from the battery is terminated in order to prevent battery leakage.

While the lighting system described in more detail below provides a significant amount of visual information and feedback to a user, the actual user interface can be quite simple and easy to understand and operate. Two momentary switches allow a user to place the lighting system in an "on", "off" or test mode and to control operation of the night beacon. One dual color "red/green" LED or one red LED and one green LED blinks three times in green when the on button is pressed, and three times in red when the off button is pressed. This visually confirms the operating state of the lighting system and that the system is functional when either button is pressed. A dedicated red LED provides a low battery indication and dedicated blue LED provides a night beacon function.

DETAILED DESCRIPTION OF REPRESENTATIVE EMBODIMENTS

Figure 1:
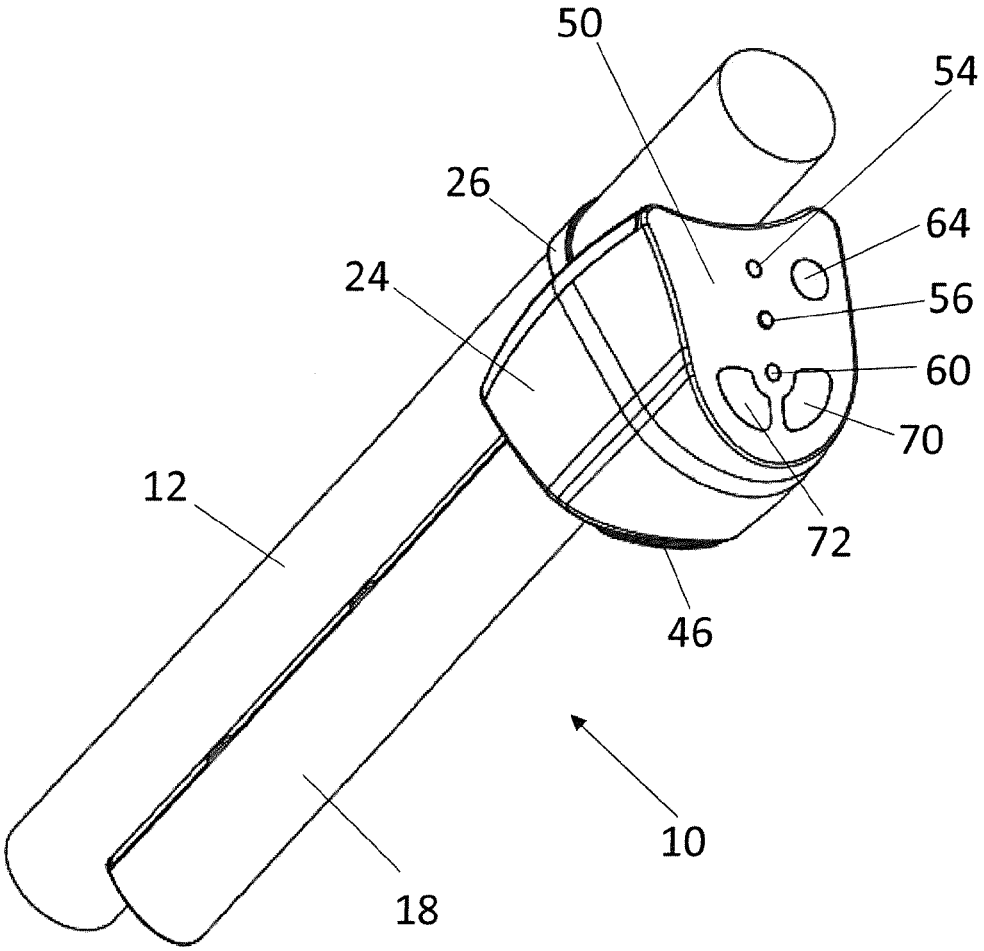
FIG. 1 is a perspective view of a representative embodiment of a lighting system constructed in accordance with this disclosure and coupled to a movable object.
Figure 2:
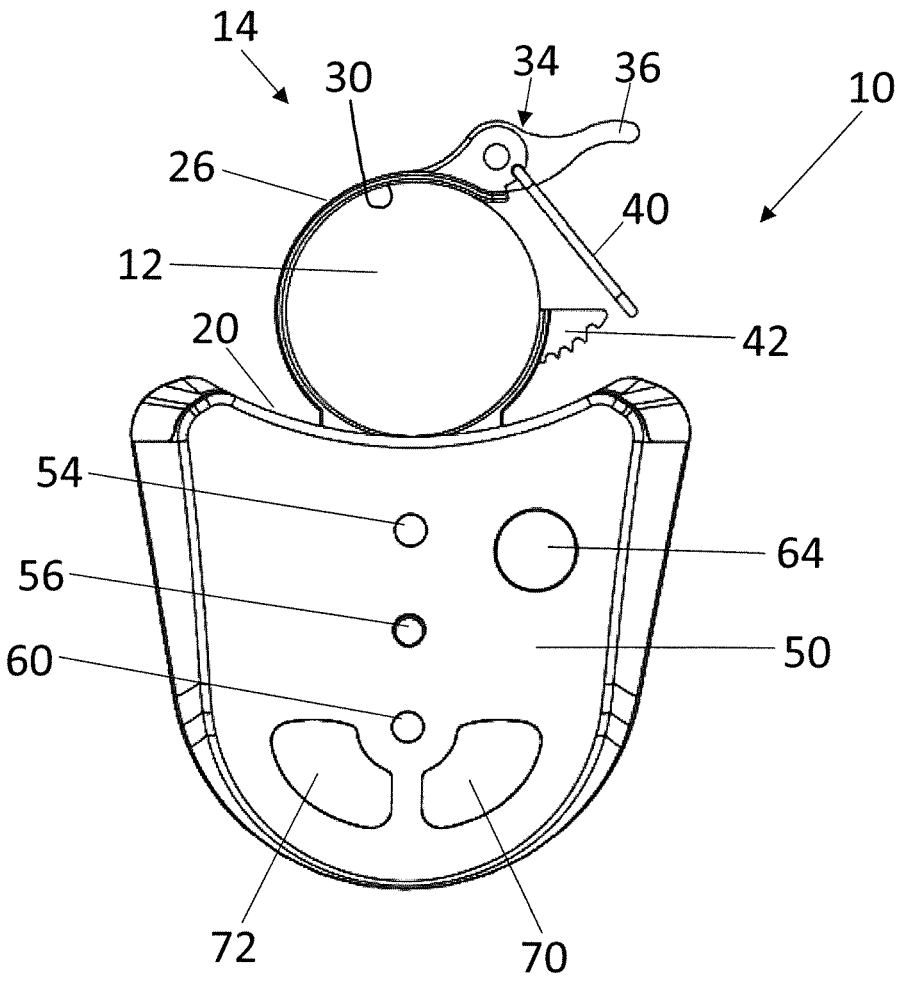
FIG. 2 is an enlarged top view of FIG. 1.

A portable lightweight lighting system 10 is shown in FIGS. 1, and 2 attached to a portion of a movable object 12, such as a walking stick or cane. A releasable coupling 14 clamps the lighting system 10 to the object 12, which in this example is a cylindrical rod. A stabilizing sleeve 18 is provided on the lighting system with an arched inner surface that embraces the object 12 to help to hold the lighting system 10 in a desired position on the object 12.

Figure 3:
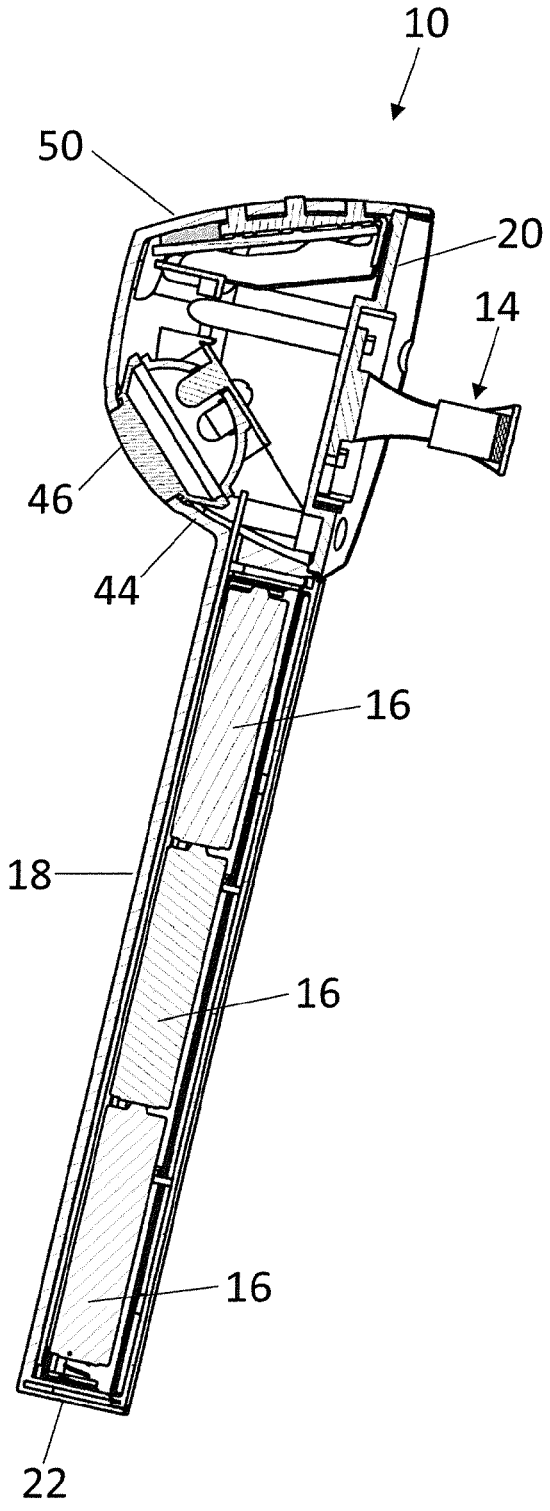
FIG. 3 is a longitudinal sectional view through the lighting system of FIG. 1.

As shown in FIG. 3, in one embodiment, the stabilizing sleeve 18 can be formed as an elongated hollow tube which serves as an easy access battery compartment. Several batteries 16 can be stacked in series in a single column within the sleeve 18 to simplify battery installation. That is, by avoiding a side-by-side battery installation, improper orientation of the batteries is reduced or avoided. The outer convex side of the sleeve can be simply snapped or slid on and off the inner concave side of the sleeve to install and remove the batteries or a removable end cap 22 can be provided for battery installation and replacement. Upon installation of new batteries, the lighting system enters the standby or sleep mode.

As further seen in FIGS. 1, 2 and 3, the coupling 14 is fixed on a rear wall portion 20 of a housing 24. An adjustable locking ring 26 is lined with a soft rubber or foam material 30 for gripping and conforming to the outer surface of the movable object 12. A releasable latch 34 includes an over-center lever 36 which selectively engages and releases a loop or clasp 40 on and off a serrated anchor portion 42.

The rear wall 20 can include a removable wall portion for the installation and removal of batteries which provide a power source for the lighting system 10. The sleeve 18 and the housing 24 can be integrally or homogeneously molded of a durable lightweight plastic material. A number of openings or apertures are formed in the housing 24 for receiving one or more illuminating lights such as pathway illuminating lights, as well as indicating lights and switch actuators.

That is, as further seen in FIGS. 1 and 3, the bottom wall 44 of the housing 24 includes one or more pathway illuminating lights 46, such as one or more white light LEDs 46. The top wall 50 of the housing 24 includes a low battery indicator LED 54, (red) a night beacon indicator LED 56 (blue) and an on-off dual color indicator LED 60 (green/red).

The top wall 50 also includes an opening for a light sensor such as a photo transistor 64. Alternatively, the photo transistor can be mounted on the rear wall 20. An "on" switch 70 can be a momentary contact button switch, as can an "off" switch 72. Briefly pressing the on switch 70 causes LED 60 to blink green and briefly pressing the off switch 72 causes LED 60 to blink red.

Figure 4:
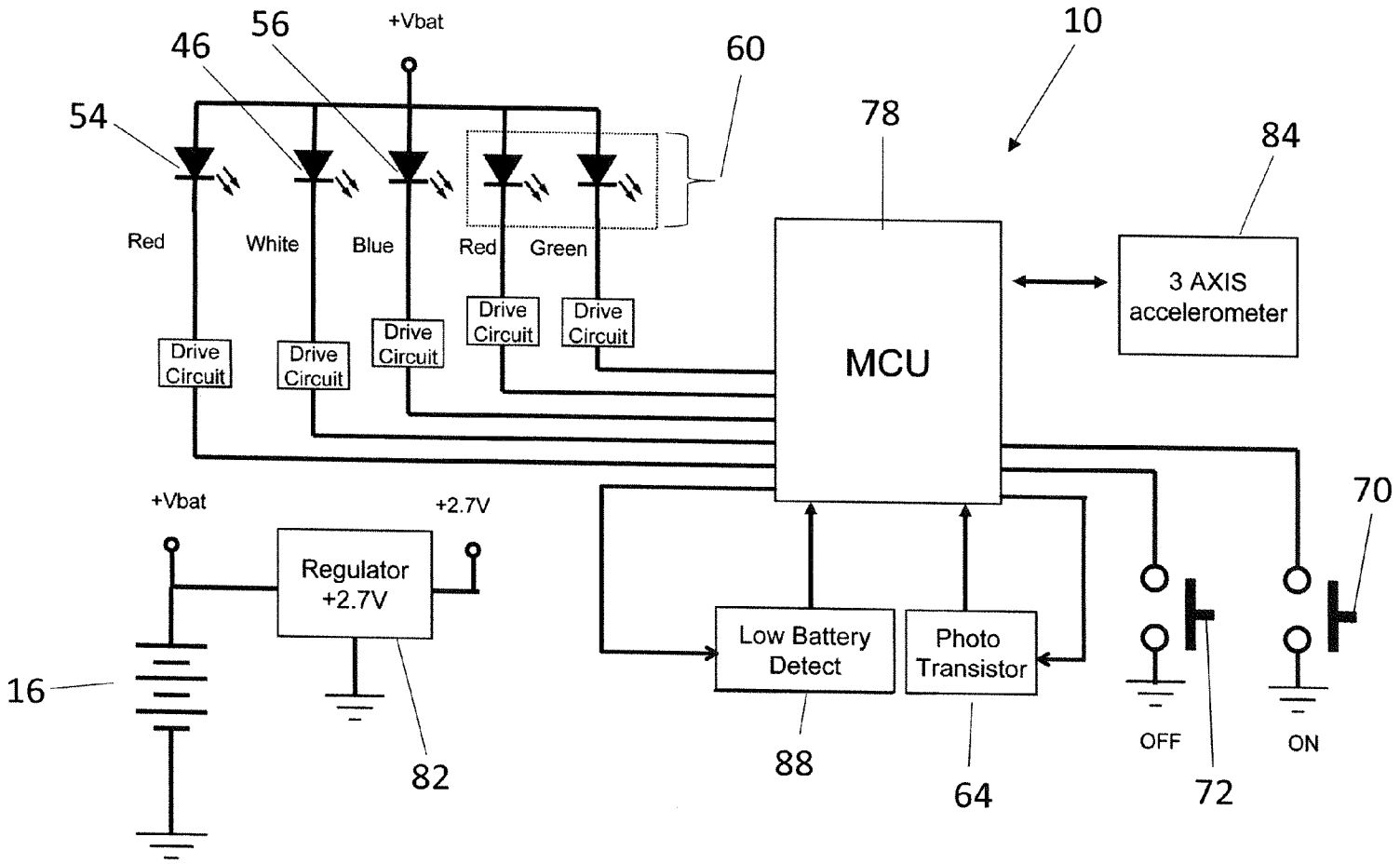
FIG. 4 is a block diagram of the electronics and microprocessor inputs and outputs for the lighting system of FIG. 1.

As seen in FIG. 4, the lighting system 10 is controlled by a microprocessor 78 which is powered by a power source such as one or more batteries 16. In one embodiment, three "AAA" batteries can be used in combination with a conventional voltage regulator 82. When batteries are installed, firmware in the microprocessor 78 is initialized and sets the night beacon indicator light 56 to a default on or active mode. A user can deactivate and turn off the night beacon indicator light 56 by, for example, pressing the off button switch 72 for an extended period or duration of several seconds, such as five seconds or more. Pressing the off button switch 72 again for an extended period or duration, such as five seconds or more, will reactivate the night beacon operation mode and extinguish the night beacon indicator light 56. This activation and deactivation can be repeated sequentially from either the on mode or the off mode of light system operation.

Movement of the lighting system 10 is detected by a motion sensor such as a three axis accelerometer circuit 84 which detects motion in all three dimensions of space.

A low battery detection circuit 88 causes LED 54 to flash or blink upon the batteries 16 reaching a preset low power/voltage level.

Figure 5A:
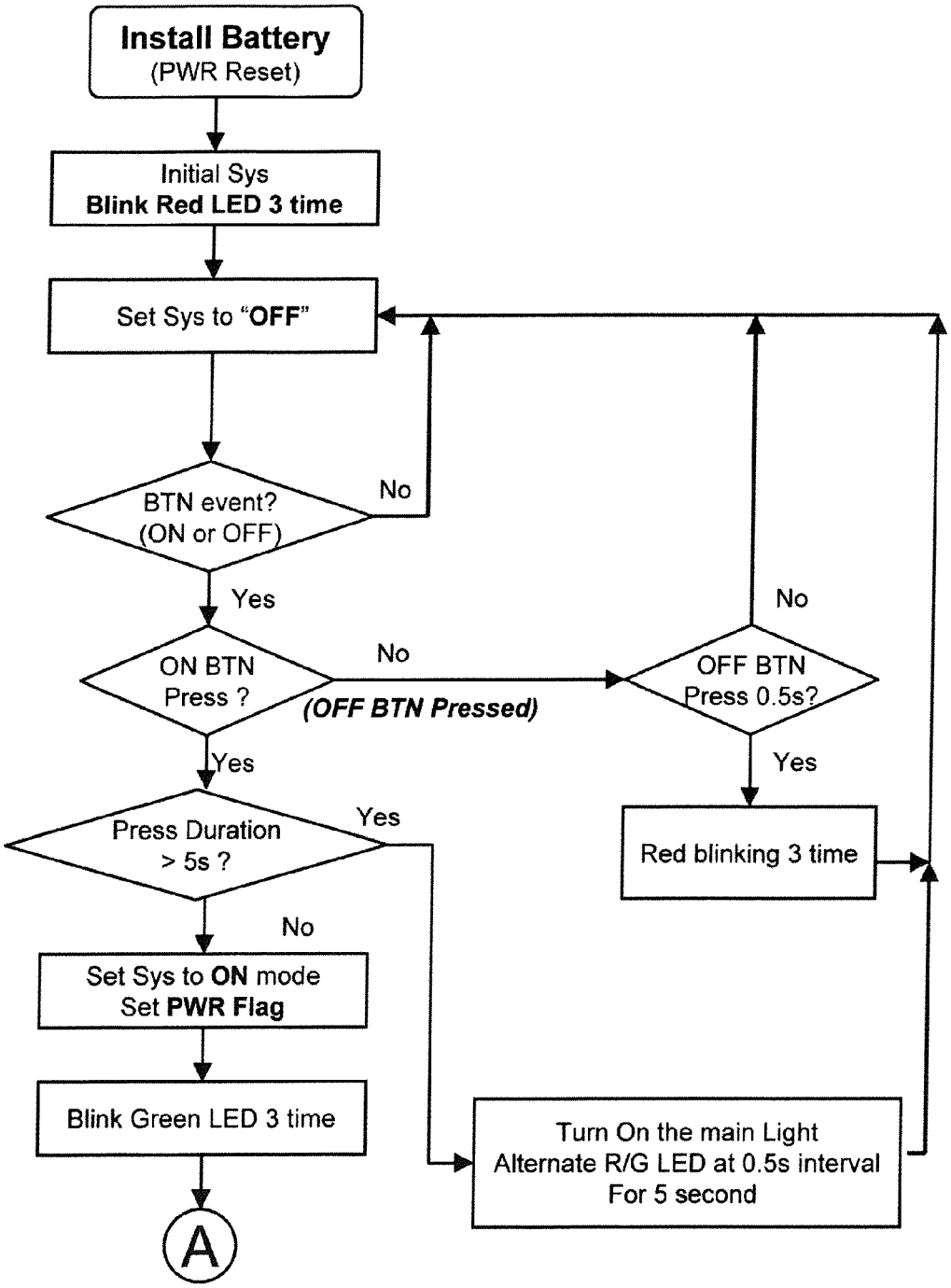
FIGS. 5*a*, 5*b* and 5*c* depict a logic flow chart for programming the microprocessor of FIG. 4.
Figure 5B:
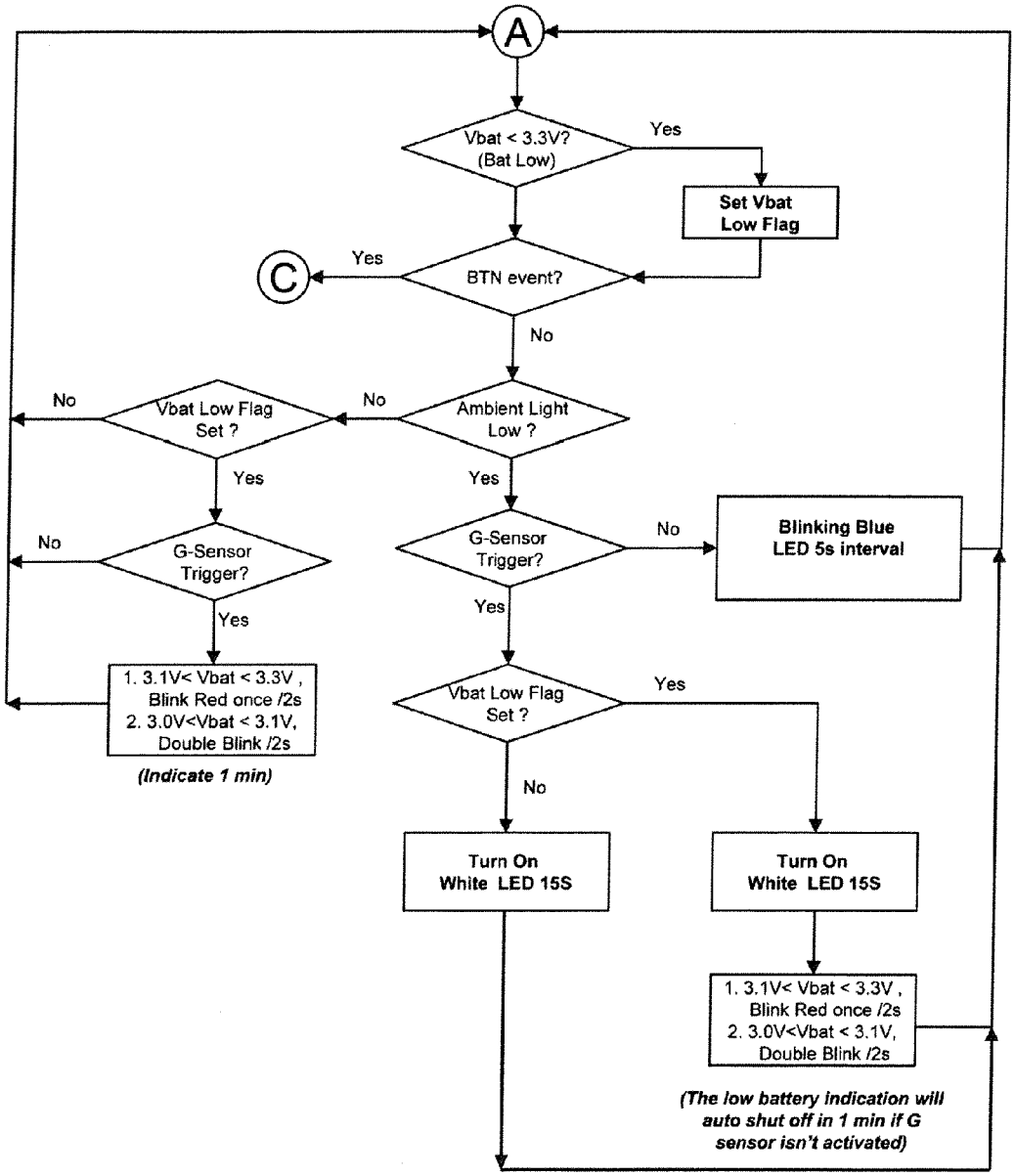
Figure 5C:
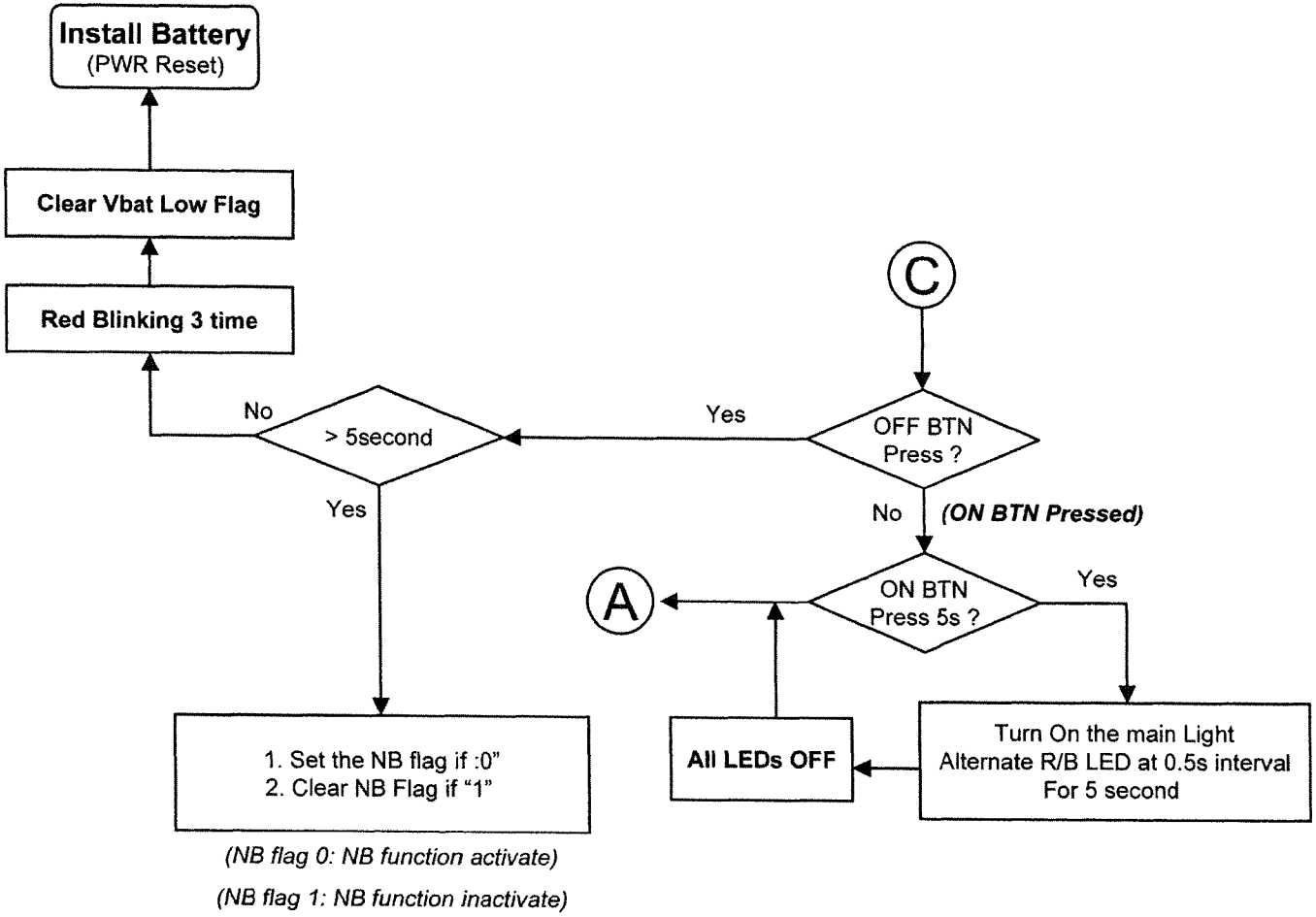

Microprocessor 78 is programmed to control the lighting system 10 as described herein. An example of the program logic for the microprocessor 78 is shown in the flow chart of FIGS. 5*a*, 5*b* and 5*c*. Representative electronic circuits for providing input signals to the microprocessor 78 and for operating the lighting system 10 based on outputs from the microprocessor 10 in accordance with the flow chart of FIGS. 5*a*, 5*b* and 5*c* are shown in FIGS. 6 and 7.

Figure 6:
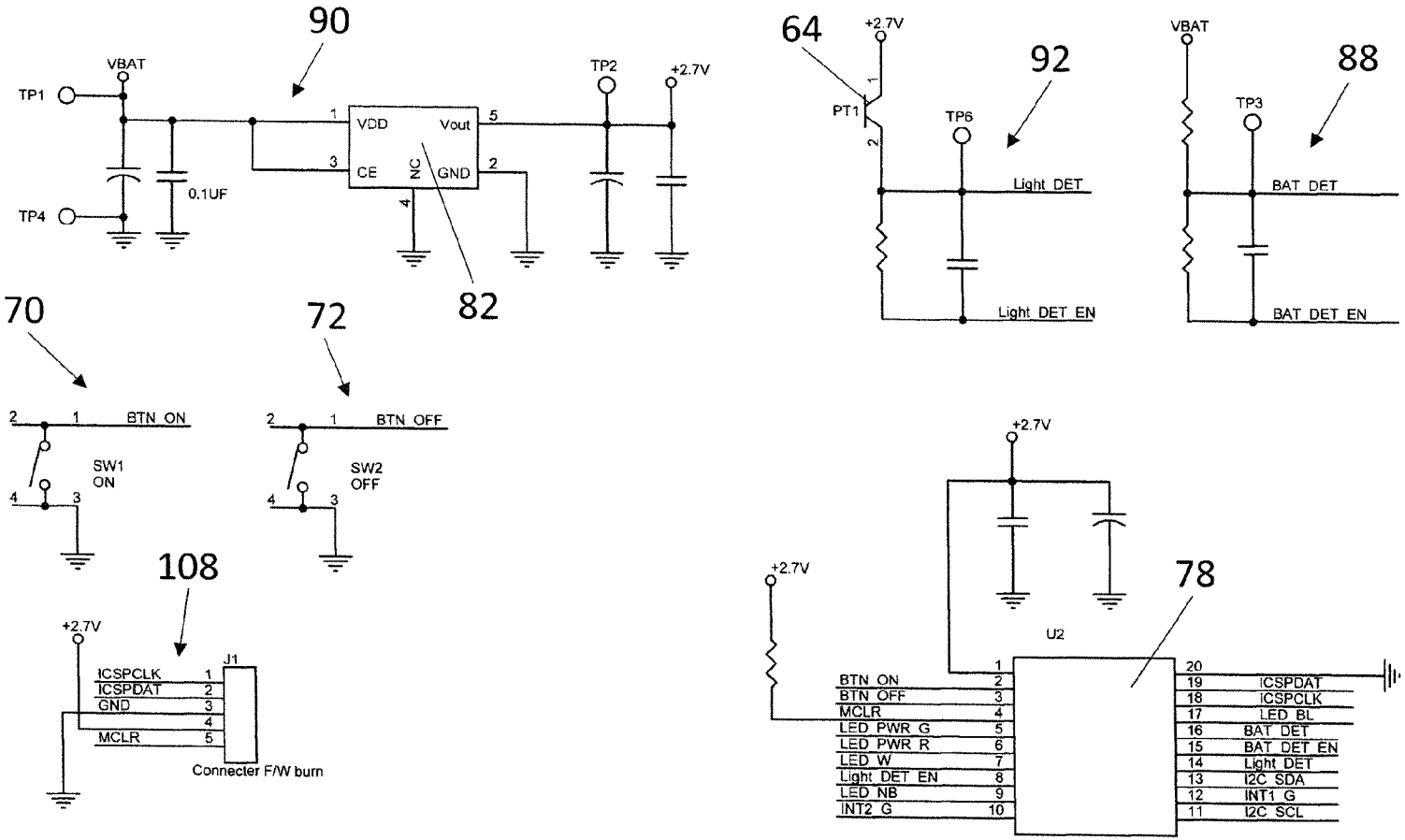
FIGS. 6 and 7 depict representative circuits providing inputs to and outputs from the microprocessor of FIG. 4
Figure 7:
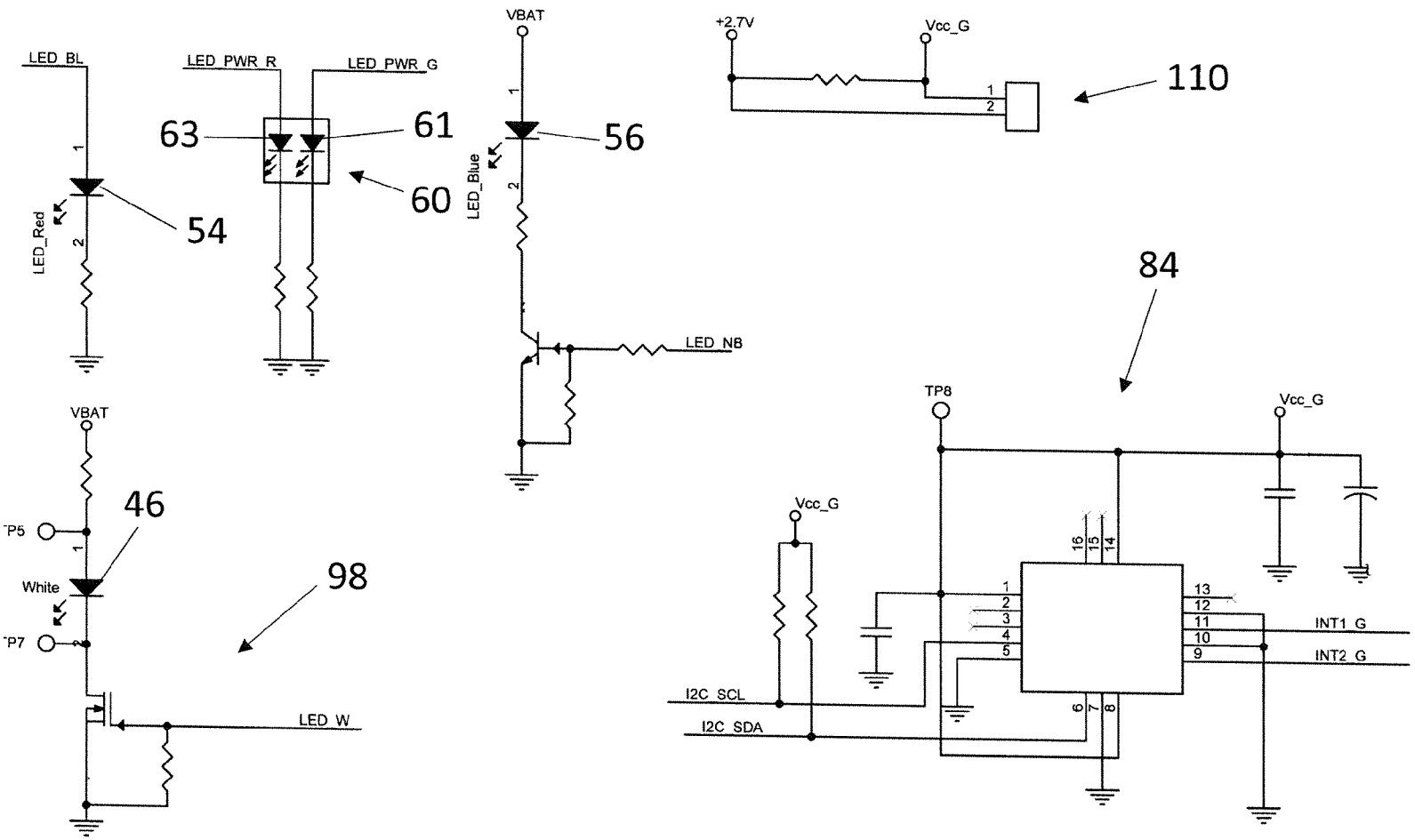

As shown in FIGS. 6 and 7, the microprocessor 78 receives a number of inputs which are processed by hardware and associated firmware programming that control the operation of the lighting system 10 and its various functions as described further below. A battery assembly 90 includes one or more batteries 16 (FIG. 4) supplying power to a standard voltage regulator circuit 82 (FIG. 4). The output from the voltage regulator 82 powers all electronics except for all of the LEDs as well as the low battery detection circuit 88 which are powered directly from the batteries 16. This allows for the use of a smaller, lighter and less expensive voltage regulator.

By momentarily pressing the on button switch 70, an interrupt service routine causes the microprocessor 78 to activate the LED 60 such that it blinks or flashes three times in green color thereby acknowledging that the lighting system has entered the "on" operational mode. Firmware within the microprocessor 78 switches the lighting system 10 from its "off" mode to its active "on" mode in response to depression of the on button 70. In the on mode, the photo transistor circuit 92 and the low battery detection circuit 88 are periodically activated, such as once every fifty milliseconds, to sample or poll these circuits. Polling these circuits conserves battery life, as compared to continuous monitoring and use of battery power. The sampled or polled circuits together with motion level values provided by the accelerometer 84 are periodically provided as inputs to the microprocessor 78. Polling can occur at any suitable interval, such as once every 50 milliseconds.

When the on mode is selected by a user, and when ambient light is detected below a predetermined level and while motion is detected above a predetermined level, the path illuminating LEDs 46 are illuminated, for example, for fifteen seconds to illuminate a path of light, such as in front of and at a downward angle from the housing 24. As shown in FIG. 7, the white LED 46 is driven by an illumination circuit 98.

At the end of each (fifteen second) interval of path illumination, each LED will continue to illuminate a path of light for an additional (fifteen second) interval provided the predetermined levels of ambient light and motion have been sensed by the photo transistor 64 and the accelerometer circuit 84 during the prior (fifteen second) interval. If either the ambient light level increases above a predetermined preset value or the motion level falls below a predetermined preset value, or both, the microprocessor 78 turns off the path illumination LEDs 46 and continues to samples these levels. If the ambient light level decreases below its preset value and the motion level increases above its preset value, the microprocessor 78 will again illuminate the primary path illuminating LEDs 46.

An accelerometer circuit 84 for a three axis accelerometer is shown in FIG. 7. This accelerometer is commercially available from the ST Micro Company. The accelerometer circuit 84 can include a set of three micro machined capacitors produced with MEMS technology wherein the capacitance of the capacitors varies in response to changes in external acceleration forces. The accelerometer circuit 84 includes hardware and built in firmware for detecting vibrations and measuring acceleration in all three directions of motion.

A conventional well known interface, such as an I2C communication interface, is provided between the microprocessor 78 and the accelerometer circuit 84 along with accelerometer interrupt lines that connect to inputs of the microprocessor 78. The communication interface and interrupt lines provide a system for determining when motion occurs and for communicating that information to the microprocessor 78.

The microprocessor 78 sets a motion threshold level at the accelerometer circuit 84 via the I2C interface. When the accelerometer circuit 84 detects motion or vibration levels that exceed a predetermined threshold stored in the accelerometer circuit's memory, the accelerometer circuit 84 activates an interrupt line which is connected the microprocessor 78. This in turn causes the microprocessor firmware to activate an interrupt service routine that uses the I2C interface to request and receive motion level information from the accelerometer circuit 84. This informs the microprocessor that one of two enabling conditions exists for turning on the pathway light 46.

The second required enabling condition is based on the level of ambient light detected by the photo transistor 64 and processed through the photo transistor circuit 92. At regular intervals a microprocessor output switches to a low state which causes the photo transistor to become active. This periodic sampling of the photo transistor conserves battery life.

If the level of ambient light sensed by the photo transistor circuit 92 falls below a predetermined level and if the level of motion detected by the accelerometer circuit 84 is below a preset or predetermined level, the firmware will activate a microprocessor output that causes the night beacon 56 to begin blinking at a predetermined rate of, for example, once every five seconds. This assists a user in locating the lighting system 10 in the dark. While in the "on" operating mode and while the ambient light level signal from the photo transistor circuit is above a predetermined threshold, firmware in the microprocessor 78 ensures that the path illuminating LEDs 46 will not become active over its predetermined operating period of, for example, fifteen seconds.

As further seen in FIG. 6, the low battery detection circuit 88 includes a voltage divider within the low battery detection circuit 88. The output from the voltage divider is connected to an analog to digital input on the microprocessor 78. The low battery detection circuit 96 is periodically activated by the microprocessor 78 by switching one of its outputs to a "low" or ground state, thereby completing the low battery detection circuit.

The output of the low battery detection circuit 88 is connected to an analog to digital input on the microprocessor 78 to periodically sample and determine the exact voltage remaining in the batteries. The low battery LED 54 can blink or flash at a predetermined rate of, for example, once every two seconds when the battery level drops below a first predetermined level. When the battery level drops below a second predetermined voltage level, the low battery LED 54 blinks or flashes, for example, twice in quick succession every two seconds. When the battery level drops below a third predetermined voltage level, the microprocessor 78 terminates all use of the batteries to prevent battery leakage.

To determine if the lighting system is fully functional, a test mode can be activated by pressing and holding the on button switch 70 for an extended predetermined period, such as five seconds or more. After this predetermined period the path illuminating LED 46 will turn on for an extended period of, for example, five seconds and also illuminate the red and green LEDs 60 in an alternating sequence. This test function can be activated from either the on or off operating mode. After the test is completed, the lighting system 10 automatically returns to its previous operating mode. This function is resident on the firmware on the microprocessor 78.

To turn the lighting system off or place it in a standby or sleep mode, a user can momentarily (for a short period or duration) depress the off button switch 72 which activates an interrupt service routine which causes the microprocessor 78 to activate the red LED 63 so that it blinks or flashes, for example, three times in acknowledgement that the system has switched modes from on to off. In this mode, the microprocessor 78 enters a sleep mode to conserve battery power, but can become active by momentarily pressing the on button switch 70. Momentarily and briefly are meant to mean less than one or two seconds.

Programming the microprocessor 78 is facilitated through an on board connector 108 that connects to an external programming device. A connector 110 is used only during on board microprocessor programming. The microprocessor programming voltage exceeds the maximum allowable voltage of the accelerometer circuit 84 so that during programming a jumper is removed from the connector 110 in order to prevent the elevated programming supply voltage from damaging the accelerometer circuit 100.

There has been disclosed the best embodiment as presently contemplated. Numerous modifications and variations of the disclosure are possible in light of the above teachings. It is therefore to be understood that within the scope of the disclosure, the concepts, methods and systems may be practiced otherwise than as specifically described above.

What is claimed is:

1. A compact, portable lighting system, comprising:

a housing;

a power source carried by said housing;

a primary source of illumination carried by said housing for providing an illuminated path of light, said primary source of illumination comprising a light emitting diode emitting white light and powered to shine brightly;

a microprocessor carried by said housing;

an ambient light sensor carried by said housing, said ambient light sensor providing a first input signal to said microprocessor when ambient light falls below a first predetermined level;

a motion sensor carried by said housing, said motion sensor comprising a three axis accelerometer measuring movement in three dimensions, said motion sensor providing a second input signal to said microprocessor when said housing undergoes motion above a predetermined motion level in any one of said three dimensions;

said microprocessor switching power from said over source to said primary source of illumination upon receiving both said first and second input signals and thereby causing said primary source of illumination to provide said illuminated path of light;

a pulsed low power, low lumen locating light carried by said housing and operable only below a second predetermined level of ambient light and only below said predetermined motion level, said pulsed low power, low lumen locating light comprising a night light for locating said lighting system in the dark; and a first user actuated switch carried by said housing and which selectively enables and prevents illumination of said pulsed low power, low lumen locating light and allows a user to selectively turn off said night light to facilitate sleep.

2. The lighting system of claim 1, wherein said first user activated switch comprises a first momentary off switch which when briefly pressed for a first short duration turns off said primary source of illumination and places said microprocessor in a low power standby mode.

3. The lighting system of claim 2, wherein said first momentary off switch, when pressed for a second duration longer than said first short duration, prevents illumination of said pulsed low power, low lumen locating light and when pressed again for a third duration, longer than said first duration, enables illumination of said pulsed low power low lumen locating light.

4. The lighting system of claim 2, further comprising a first pulsed indicating light carried by said housing, said first pulsed indicating light pulsing a predetermined number of times when said microprocessor is placed in said standby mode.

5. The lighting system of claim 1, further comprising a second user actuated switch carried by said housing and which selectively enables illumination of said primary source of illumination.

6. The lighting system of claim 5, wherein said second user actuated switch comprises a momentary on switch which when briefly pressed for a second short duration, places said microprocessor in a fully powered on mode.

7. The lighting system of claim 6, further comprising a second pulsed indicating light carried by said housing, said second pulsed indicating light pulsing a predetermined number of tunes when said microprocessor is placed in said fully powered on mode.

8. The lighting system of claim 6, wherein said momentary on switch, when pressed for a fourth duration longer than said second short duration, illuminates said primary source of illumination for a predetermined period of time.

9. The lighting system of claim 8, further comprising a second pulsed indicating light which pulses during said fourth duration.

10. The lighting system of claim 9, wherein said second pulsed indicating light comprises a dual color light emitting diode which alternately pulses first and second colors of light.

11. The lighting system of claim 1, further comprising a low battery indicator light which begins pulsing in single pulses at a first low battery voltage level and which pulses in double pulses at a second lower battery voltage level.

12. The lighting system of claim 1, wherein said microprocessor turns off said power source upon voltage from said power source reaching a predetermined low level.

13. The lighting system of claim 1, wherein said movable object is selected from the group consisting of a walking stick, a cane, a walker, a wheel chair, a crutch, a helmet, a bicycle, a belt, a collar, a halter, footwear, a headlamp and clothing.

14. The lighting system of claim 1, wherein said microprocessor causes said primary source of illumination to illuminate for at least a first predetermined period of time.

15. A method of locating and operating a portable lighting system in low light and dark ambient conditions wherein said method comprises:

providing a portable lighting system with a motion sensor comprising a three axis accelerometer measuring movement in three dimensions, a light sensor, a locating night light, a first user actuated switch and a microprocessor;

sending motion signals to said microprocessor with said motion sensor;

sending ambient light signals to said microprocessor with said light sensor;

illuminating said locating night light with an output from said microprocessor only when both said motion signals fall below a predetermined value and said ambient light signals fall below a predetermined value; and selectively enabling and disabling illumination of said locating night light with said first user actuated switch.

* * * * *